US007585088B2

(12) United States Patent
Tyson

(10) Patent No.: US 7,585,088 B2
(45) Date of Patent: Sep. 8, 2009

(54) FLUORESCENT LAMP FIXTURE

(75) Inventor: Glenn M. Tyson, La Crescenta, CA (US)

(73) Assignee: ABL IP Holding LLC, Conyers, GA (US)

( * ) Notice: Subject to any disclaimer, the term of this patent is extended or adjusted under 35 U.S.C. 154(b) by 0 days.

(21) Appl. No.: 11/695,718

(22) Filed: Apr. 3, 2007

(65) Prior Publication Data

US 2008/0247171 A1 Oct. 9, 2008

(51) Int. Cl.
*F21S 4/00* (2006.01)

(52) U.S. Cl. ..... 362/225; 362/223; 362/298; 362/346

(58) Field of Classification Search ..... 362/223, 362/225, 241, 243, 245, 260, 297, 298, 299, 362/300, 301, 304, 307, 308, 326, 327, 346
See application file for complete search history.

(56) References Cited

U.S. PATENT DOCUMENTS 4,310,876 A * 1/1982 Small et al. ..... 362/346
4,580,200 A * 4/1986 Hess et al. ..... 362/223
4,794,501 A * 12/1988 Bartenbach ..... 362/298
4,799,134 A * 1/1989 Pinch et al. ..... 362/260
4,866,584 A * 9/1989 Plewman ..... 362/225
5,062,030 A * 10/1991 Figueroa ..... 362/346
5,195,818 A * 3/1993 Simmons et al. ..... 362/299
6,729,741 B1 * 5/2004 Murray ..... 362/297
2006/0227552 A1 10/2006 Tyson ..... 362/260

* cited by examiner

*Primary Examiner*—Y My Quach Lee
(74) *Attorney, Agent, or Firm*—Connolly Bove Lodge & Hutz LLP

(57) ABSTRACT

A fluorescent lamp fixture includes a housing (10), an elongate reflector (30) on one side of the housing (10) with two sets of fluorescent lamp sockets (24, 26) extending from the reflector (30) and a refracting lens (52) extending over the reflector (30) and fluorescent lamp sockets (24, 26). A second reflector (44) is positioned to extend across and face the first reflector (30) with two fluorescent lamps (28) mounted between the two reflectors (30, 44). The second reflector (44) includes reflective longitudinal surfaces (46, 48) on either side of the reflector (44) to reflect light from the adjacent fluorescent lamps (28) laterally thereof. The principal reflector (30) is a diffuse reflector while the second reflector (44) is a specular reflector. The specular reflector (44) is mounted to the refracting lens (52).

21 Claims, 3 Drawing Sheets

FLUORESCENT LAMP FIXTURE

BACKGROUND OF THE INVENTION

The field of the present invention is fixtures and components for fluorescent lamps.

Fluorescent lighting has long provided cost effective, efficient and low heat artificial light sources finding utility, inter alia, for overhead lighting in buildings and other structures. Such lighting fixtures typically employ multiple elongate fluorescent tubes arranged horizontally to one side of a reflector and covered by a lens. Such fixtures are commonly found supported on a ceiling of a building structure.

With the advent of mechanisms for enhancing brightness and reducing striking requirements in colder environments, such fluorescent lamps are capable of being employed in garage environments where the ambient temperature is not maintained above the outdoor temperature. One such device for enhancing brightness and striking is illustrated in U.S. Patent Publication 2006/0227552, published Oct. 12, 2006 in the name of Glenn M. Tyson, the disclosure of which is incorporated herein by reference.

In garages having a typical commercial garage layout, a center aisle flanked by parking spaces extending laterally away from the aisle have recommended standards employing a maximum/minimum horizontal illumination uniformity ratio of 10:1. With central lighting in the aisles, the maximum light intensity is found beneath the fixtures while the minimum is found at the outside edges of the parking spaces. Typically, flood light luminaires employed in rows parallel to the center aisle are spaced and arranged to meet the appropriate standard.

SUMMARY OF THE INVENTION

The present invention is directed to a fluorescent lamp fixture which employs a fixture housing, an elongate first reflector to one side of the housing and at least one set of fluorescent lamp sockets extending outwardly of the first reflector to define fluorescent lamp mounting location for receipt of fluorescent tube(s).

In a first separate aspect of the present invention, an elongate second reflector is displaced from and faces the first reflector. The first reflector extends laterally in both directions beyond the second reflector and the second reflector extends laterally outwardly of the fluorescent lamp mounting location. This second reflector has two reflective longitudinal surfaces on either side to reflect light from the adjacent fluorescent lamp mounting laterally of the second reflector directly from the fixture housing. This arrangement directs such light outwardly to reduce the maximum/minimum horizontal illumination uniformity ratio.

In a second separate aspect of the present invention, an elongate second reflector is displaced from and faces the first reflector. The first reflector extends laterally in both directions beyond the second reflector and the second reflector extends fully across and laterally outwardly of the fluorescent lamp mounting location. This second reflector has two reflective longitudinal surfaces on either side to reflect light from the adjacent fluorescent lamp mounting locations laterally of the second reflector. This arrangement reduces glare downwardly and directs such light outwardly to reduce the maximum/minimum horizontal illumination uniformity ratio.

In a third separate aspect of the present invention, an elongate second reflector is displaced from and faces the first reflector. The first reflector extends laterally in both directions beyond the second reflector and the second reflector extends fully across and laterally outwardly of the fluorescent lamp mounting location. This second reflector has two reflective longitudinal surfaces on either side to reflect light from the adjacent fluorescent lamp mount laterally of the second reflector. The first reflector is a diffuse reflector while the second reflector is a specular reflector. This arrangement eliminates light shining directly down from the fluorescent lamp mounting locations. The reflective surfaces are chosen to provide additional diffuse light downwardly to fill in beneath the second reflector while efficiently transmitting direct light outwardly to the lateral extent of the coverage. The reflective longitudinal surfaces direct such light outwardly to reduce the maximum/minimum horizontal illumination uniformity ratio.

In a fourth separate aspect of the present invention, an elongate second reflector is displaced from and faces the first reflector. The first reflector extends laterally in both directions beyond the second reflector and the second reflector extends laterally outwardly of the fluorescent lamp mounting location. This second reflector has two reflective longitudinal surfaces on either side to reflect light from the adjacent fluorescent lamp mount laterally of the second reflector. The reflective longitudinal surfaces direct such light outwardly to reduce the maximum/minimum horizontal illumination uniformity ratio. A refracting lens is arranged over the fluorescent lamp mounting locations and the reflectors to distribute and diffuse light from the fixture. This refracting lens may further mount the second reflector.

In a fifth separate aspect of the present invention, an elongate second reflector is displaced from and faces the first reflector. The first reflector extends laterally in both directions beyond the second reflector and the second reflector extends laterally outwardly of the fluorescent lamp mounting location. This second reflector has two reflective longitudinal surfaces on either side to reflect light from the adjacent fluorescent lamp mount laterally of the second reflector. A refracting lens is arranged over the fluorescent lamp mounting locations and the reflectors to distribute and diffuse light from the fixture. Overcenter latches are mounted on the fixture housing and include engagements depending therefrom to engage the refracting lens. Some of the engagements include springs biasing the engagements away from the refracting lens to limit the number of attachment points with the overcenter latches unlatched. This allows for a more facile removal of the refractive lens.

In a sixth separate aspect of the present invention, the elongate second reflector is displaced from and facing the first reflector. The first reflector extends laterally in both directions beyond the second reflector and has a lateral cross section comprising two concave sections. The concave sections are each further defined by substantially planar outermost, middle, and inner elements, which are disposed at different angles relative to plane of the fluorescent lamp mounting location. The second reflector extends laterally outwardly of the two fluorescent lamp mounting locations lying in a plane and has reflective longitudinal surfaces on either side to reflect light coming from the adjacent fluorescent lamp mounting location laterally of the second reflector. At least one set of fluorescent lamp sockets extends outwardly from the first reflector toward the second reflector to define a fluorescent lamp mounting location directly between the first reflector and the second reflector and longitudinally aligned with the first reflector and the second reflector.

In a seventh separate aspect of the present invention, the second reflector further comprises an elongate flat section between the reflective longitudinal surfaces. The longitudinal reflective surfaces may be provided at an angled relation relative to the plane of the fluorescent lamp mounting location. This angled relationship may be at a 43° angle relative to the plane of the fluorescent lamp mounting location.

In an eighth separate aspect of the present invention, the angles for the outermost and middle elements may be 21° and 8°, respectively, and for the inner element, 14° in the opposite rotation.

In a ninth separate aspect of the present invention, any of the foregoing aspects are contemplated to be employed in combination to greater advantage.

Thus, it is an object of the present invention to provide an improved fluorescent lamp fixture. Other and further objects and advantages will appear hereinafter.

DETAILED DESCRIPTION OF THE PREFERRED EMBODIMENT

Figure 1:
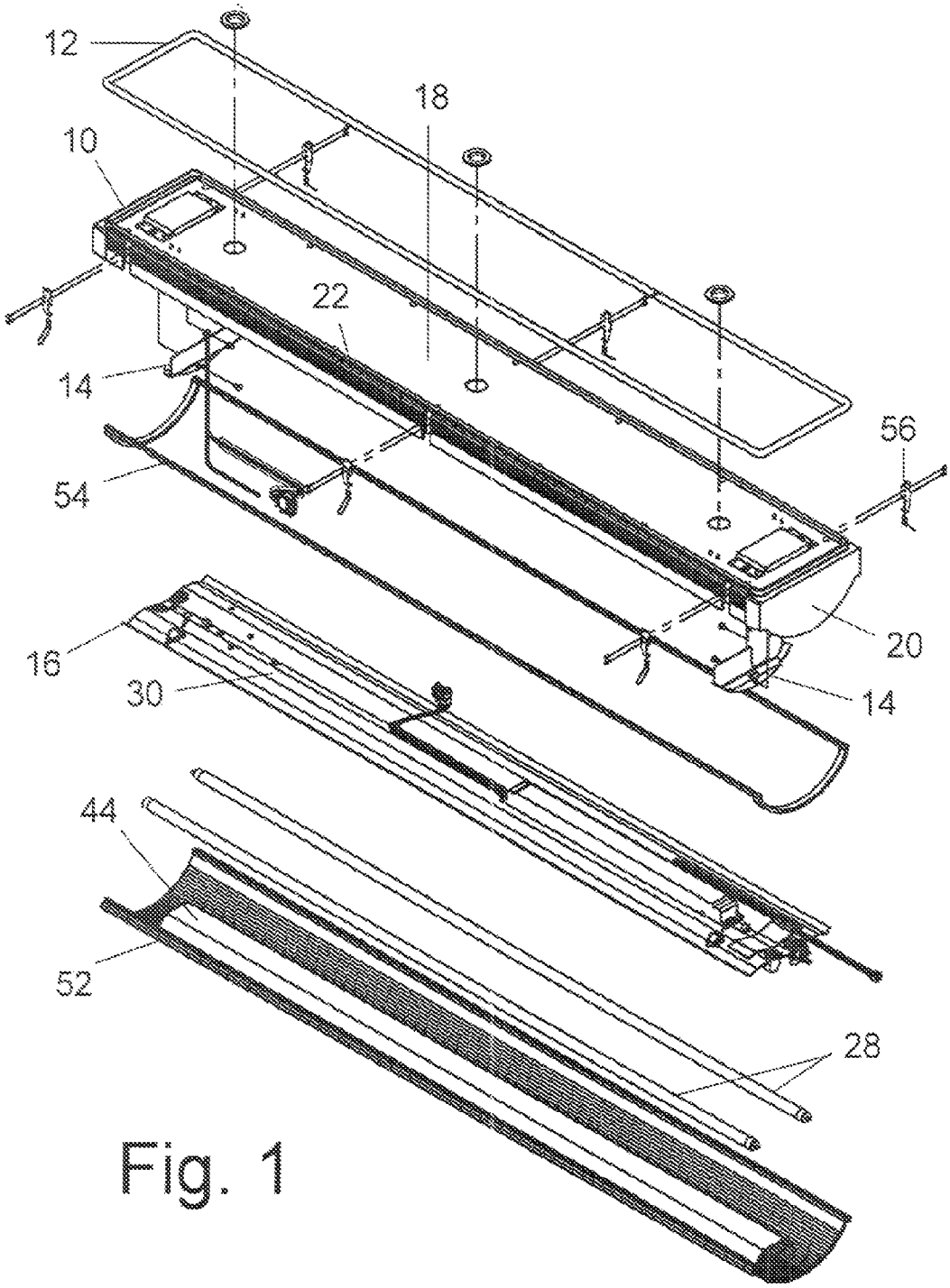
FIG. 1 is an exploded perspective view of a fluorescent lamp fixture.

Turning in detail to the drawings, FIG. 1 illustrates a lamp fixture in exploded perspective as including a ceiling housing 10, a gasket 12 for the ceiling housing 10, two wireway covers 14 and an optic subassembly 16. The ceiling housing 10 includes a flat panel 18, end plates 20 and sidewalls 22. A heater *(not shown) in accordance with U.S. Patent Publication 2006/0227552 is advantageously employed in outdoor garage applications.

Figure 2:
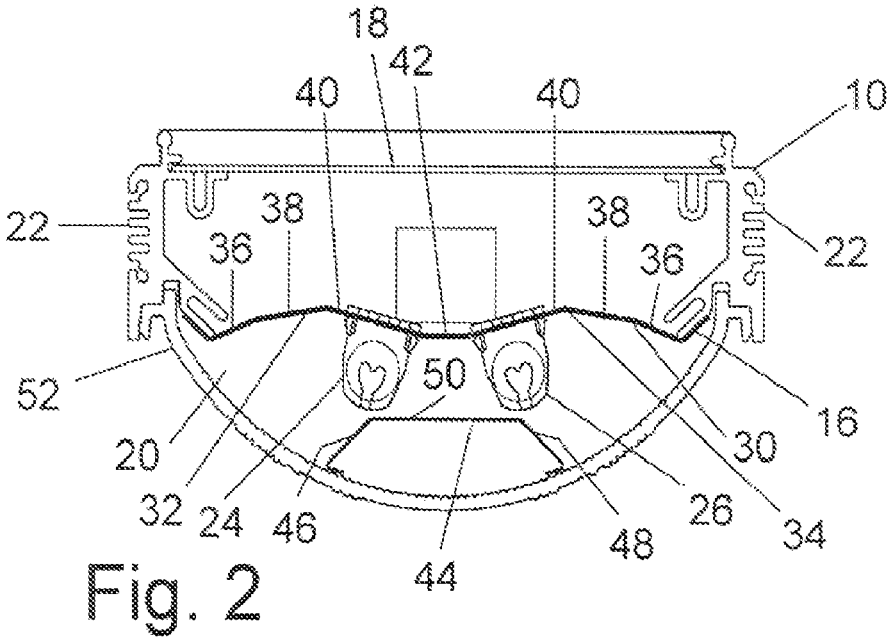
FIG. 2 is a cross-sectional view looking at a transverse cut of the assembled fixture.

Turning to FIG. 2, the optic subassembly 16 is shown in greater detail to include sockets 24, 26. The sockets 24, 26 each form half of a socket set of opposed sockets 24, 26 for a fluorescent lamp. The sockets extend outwardly from the optic subassembly 16 of the ceiling housing 10. The fluorescent lamp sockets 24, 26 thus define two fluorescent lamp mounting locations between the opposed sockets 24, 26 which lie in a plane parallel to that of the housing 10 and which mount parallel fluorescent lamps 28 that are in turn parallel to the optic subassembly 16 and in longitudinal alignment as well. The fluorescent lamps 28 in this embodiment are bi-pin 54 watt lamps, other wattages are contemplated as well.

The optic subassembly 16 also includes an elongate first reflector 30. This reflector 30 forms the lower side of the ceiling housing 10 and extends longitudinally thereof. The reflector is formed in lateral cross section with two concave sections 32, 34 with the concavity facing toward the defined fluorescent lamp mounting locations. The angles to the plane of the fluorescent lamp mounting locations found in each of the concave sections 32, 34 which have been found to be advantageous in this one particular fixture include a 21° angle for the outermost reflecting element 36, an 8° angle for the middle element 38 and a 14° angle in the opposite rotation for the inner element 40. A small center section 42 between the concave sections 32, 34 is parallel to the plane of the fluorescent lamp mounting locations.

The first reflector 30 extends laterally outwardly of the fluorescent lamp mounting locations with the lamp sockets 24, 26 being mounted to the sections 40. Light from the lamps 28 themselves and direct reflection from this first reflector 30 provide a lateral spread of light from the fixture. To increase the dispersion of light from the first reflector 30, the surface thereof is reflective white. This creates a diffuse reflector.

An elongate second reflector 44 is located to the other side of the defined fluorescent lamp mounting locations from the first elongate reflector 30, thus placing the fluorescent lamp mounting locations directly between the two reflectors 30, 44. This elongate second reflector 44 extends fully across below the fluorescent lamp mounting locations so that no direct light from the lamps 28 shines directly downwardly. This elongate second reflector 44 also extends laterally outwardly of the two fluorescent lamp mounting locations to a small extent but not so far as the elongate first reflector 30. Two reflective longitudinal surfaces 46, 48 are arranged at 43° to the plane of the fluorescent lamp mounting locations to reflect light from the adjacent fluorescent lamps 28 laterally of the second reflector 44 to extend the illumination further from the fixture. An elongate flat section 50 spans between the two reflective surfaces 46, 48 to have the elongate second reflector 44 extend fully across below the fluorescent lamps 28. The elongate second reflector 44 is a specular reflector with a polished surface to improve the efficiency of reflection in the lateral direction.

A refracting lens 52 surrounds the first and second reflectors 30, 44 and the fluorescent lamp mounting locations. The refracting lens 52 preferably extends to the end plates 22 of the housing. Further, a gasket 54 may be employed with the refracting lens 52. The refracting lens 52 is a diffuser lens of clear plastic having bumps or angles on the surface to further disperse light. The elongate second reflector 44 is conveniently mounted to the refracting lens 52 as can be seen in FIG. 2.

In operation, light from the fluorescent lamps 28 is directed laterally between the reflectors 30, 44 through the refracting lens 52. Additionally, light from the fluorescent lamps 28 encounters the elongate first reflector 30 and is generally reflected with dispersion based on the surface of the reflector 30. Thus, light is diffused to the reflective longitudinal surfaces 46, 48 and then laterally therefrom. Additionally, diffused light is reflected from the elongate first reflector 30 downwardly to fill in the area blocked beneath the elongate second reflector 44. Thus, full dispersion of the light reflected from the elongate first reflector 30 is achieved. Additionally, light directly from the fluorescent lamps 28 is also reflected in a more direct and efficient manner laterally of the fixture off of the elongate second reflector 44 because of the specular reflector surface. The refracting lens then diffuses this light as well to achieve an overall advantageous light pattern for commercial type garages.

Figure 5:
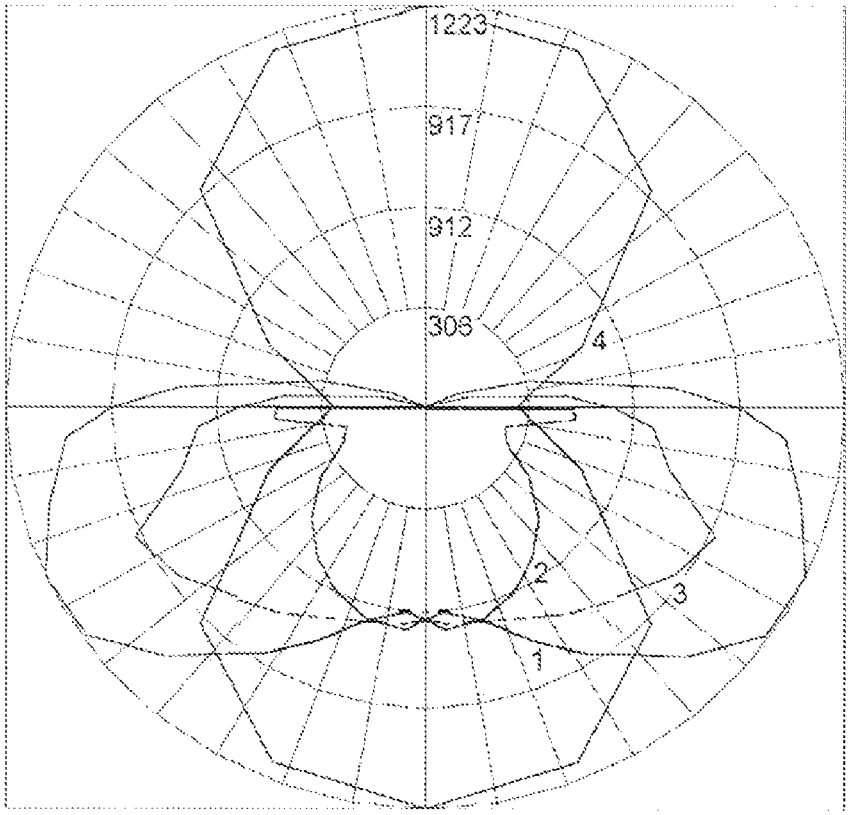
FIG. 5 is a polar graph of candela in vertical planes through various horizontal angles from tests of a preferred embodiment.

The performance of a fixture constructed in accordance with the illustrated preferred embodiment is shown in FIG. 5. Depicted is a polar graph with a maximum candela of 1223. This maximum is located at the horizontal angle of 90° at a vertical angle of 65°. In FIG. 5, line No. 1 is taken in a vertical plane through the horizontal angles 90°-270°. Line No. 2 is taken in a vertical plane through the horizontal angles 0°-180°. Line No. 3 is taken in a vertical plane through the horizontal angles 45°-225°. Line No. 4 is taken in a vertical plane through the horizontal cone angle of 65°.

Figure 3:
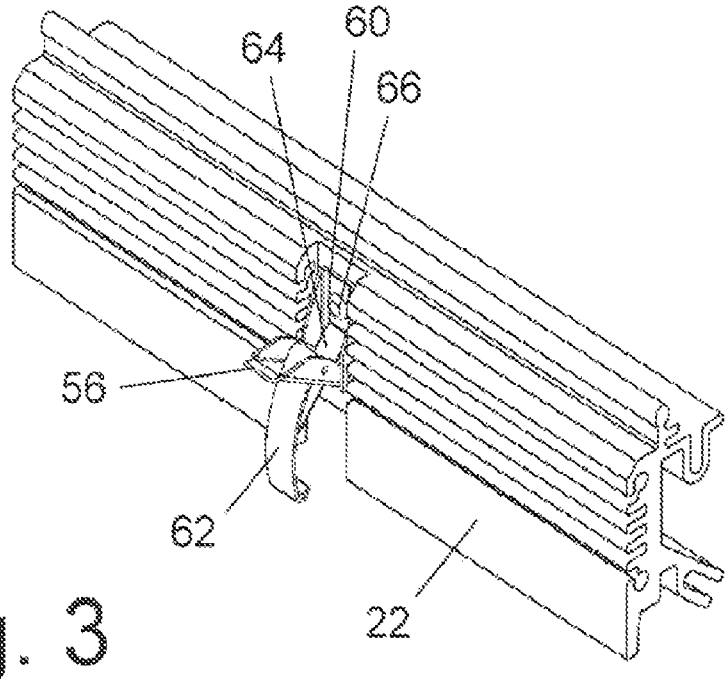
FIG. 3 is a partial perspective view of a housing with an overcenter latch.
Figure 4:
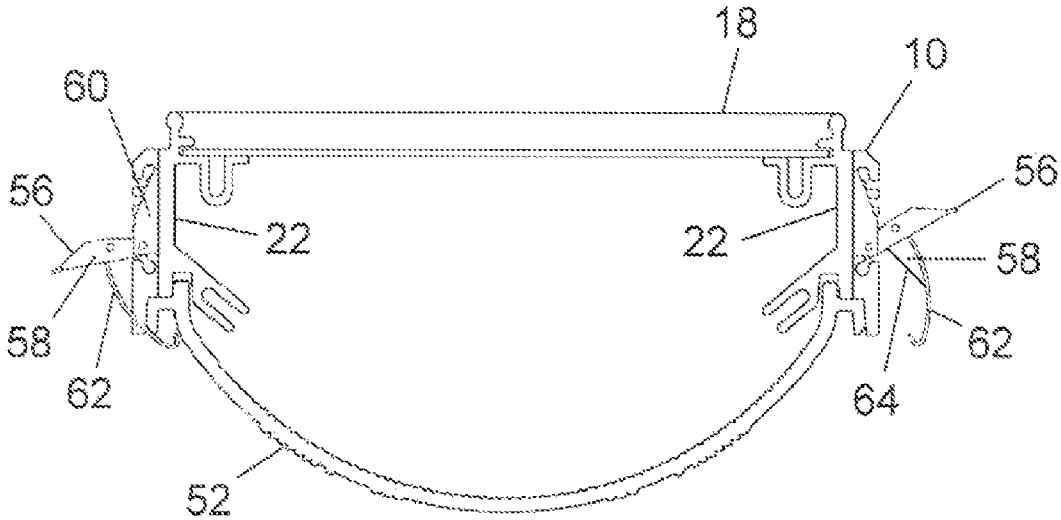
FIG. 4 is a cross-sectional view of the fluorescent lamp fixture illustrating overcenter latches to retain the refractive lens.

FIGS. 3 and 4 illustrate a latch mechanism employed to attach the lens 52 to the housing 10 and more specifically the sidewalls 22. Six overcenter latches 56 are spaced along either side of the housing 10. The latches 56 have an actuator link 58 which is pivotally mounted to a latch frame 60. An engagement 62 pivotally depends from the actuator link 58 to engage the refracting lens 52. The actuator link 58 moves overcenter to retain the refracting lens 52 in the locked position. When opened, the engagement 62 may continue to be hooked to the refracting lens 52. With multiple such latches, it becomes difficult to conveniently remove the refracting lens 52 with the depending engagements 62 continuing to be engaged with the refracting lens 52. Consequently, a leaf spring 64 is mounted to the latch frame 60 by means of a fastener 66. The leaf spring 64 is configured to force the depending engagement 62 away from the refracting lens 52 so as to not inhibit removal of the refracting lens 52 from the housing 10. By having some but not all of the overcenter latches 56 employing a leaf spring 64 to bias the engagement 62 away from the refracting lens 52, two latches 56, one on either side of the housing 10 for example, will retain the refracting lens 52 until the engagements 62 are deliberately moved from engagement.

Thus, an improved fluorescent lamp fixture is described. While embodiments and applications of this invention have been shown and described, it would be apparent to those skilled in the art that many more modifications are possible without departing from the inventive concepts herein. The invention, therefore, is not to be restricted except in the spirit of the appended claims.

What is claimed is:

1. A fluorescent lamp fixture comprising a fixture housing;

an elongate first reflector to one side of the housing;

an elongate second reflector displaced from and facing the first reflector, the first reflector extending laterally in both directions beyond the second reflector;

at least one set of fluorescent lamp sockets extending outwardly from the first reflector toward the second reflector to define a fluorescent lamp mounting location directly between the first reflector and the second reflector and longitudinally aligned with the first reflector and the second reflector, the second reflector extending laterally outwardly of the fluorescent lamp mounting location and having reflective longitudinal surfaces on either side to reflect light coming from the adjacent fluorescent lamp mounting location laterally of the second reflector directly out of the fixture housing, wherein the at least one set of sockets are positioned such that light is reflected downwardly and upwardly from the fixture by the first and second reflectors laterally through more than 180° degrees.

2. The fixture of claim 1, there being two sets of fluorescent lamp sockets defining the fluorescent lamp mounting location and the second reflector extending fully across and laterally outwardly of the two fluorescent lamp mounting location.

3. The fixture of claim 1, the first reflector being a diffuse reflector.

4. The fixture of claim 1, the reflective longitudinal surfaces being specular reflectors.

5. The fixture of claim 1 further comprising a refracting lens extending from the housing around the first reflector, the fluorescent lamp mounting location and the second reflector.

6. The fixture of claim 5, the refracting lens being a diffuser lens.

7. The fixture of claim 5, the second reflector being mounted to the refracting lens.

8. The fixture of claim 5 further comprising overcenter latches mounted on the fixture housing and including engagements depending there from to engage the refracting lens, at least some of the engagements having springs biasing the engagements away from the refracting lens.

9. The fixture of claim 1, the mounting location lying in a plane, the longitudinal reflective surfaces being at 43° to the plane of the mounting location.

10. The fixture of claim 1, the second reflector further having an elongate flat section between the reflective longitudinal surfaces.

11. The fixture of claim 1, the lateral cross section of the first reflector having two sections being concave toward the fluorescent lamp mounting-location.

12. A fluorescent lamp fixture comprising a fixture housing;

an elongate diffuse reflector to one side of the housing;

an elongate specular reflector displaced from and facing the diffuse reflector, the diffuse reflector extending laterally in both directions beyond the specular reflector;

at least two set of fluorescent lamp sockets extending outwardly of the diffuse reflector toward the specular reflector to define at least two fluorescent lamp mounting locations directly between the diffuse reflector and the specular reflector and longitudinally aligned with the diffuse reflector and the specular reflector, the specular reflector extending fully across the at least two mounting locations and laterally outwardly of the fluorescent lamp mounting locations and having reflective longitudinal surfaces on either side of the specular reflector to reflect light coming from the adjacent fluorescent lamp mounting location laterally of the specular reflector directly out of the fixture housing, wherein the at least one two set of sockets are positioned such that light is reflected downwardly and upwardly from the fixture by the diffuse and specular reflectors laterally through more than 180° degrees.

13. The fixture of claim 12 further comprising a refracting diffuser lens extending from the housing around the first reflector, the fluorescent lamp mounting location and the second reflector.

14. The fixture of claim 13, the specular reflector being mounted to the refracting lens.

15. The fixture of claim 12, the mounting location lying in a plane, the longitudinal reflective surfaces being at 43° to the plane of the mounting location.

16. The fixture of claim 12, the lateral cross section of the diffuser reflector having two sections being concave toward the fluorescent lamp mounting location.

17. The fixture of claim 12, there being two sets of fluorescent lamp sockets defining the fluorescent lamp mounting locations.

18. A fluorescent lamp fixture comprising a fixture housing;

an elongate first reflector to one side of the housing;

an elongate second reflector displaced from and facing the first reflector, the first reflector extending laterally in both directions beyond the second reflector;

at least two set of fluorescent lamp sockets spaced apart extending outwardly from the first reflector toward the second reflector to define at least two fluorescent lamp mounting locations directly between the first reflector and the second reflector and longitudinally aligned with the first reflector and the second reflector;

wherein the second reflector extends laterally and outwardly to fully overlap the at least two mounting locations and having reflective longitudinal surfaces on either side to reflect light coming from the fluorescent lamp mounting location laterally of the second reflector, wherein the at least one set of sockets are positioned such that light is reflected downwardly and upwardly from the fixture by the first and second reflectors laterally through more than 180° degrees; and wherein the lateral cross section of the first reflector comprises two concave sections, the concave sections each further defined by substantially planar outermost, middle, and inner elements disposed at different angles relative to plane of the fluorescent lamp mounting location.

19. The fixture of claim 18, the second reflector further comprising an elongate flat section between the reflective longitudinal surfaces.

20. The fixture of claim 19, the longitudinal reflective surfaces being at an angled relation relative to the plane of the fluorescent lamp mounting location.

21. The fixture of claim 18, wherein the angles for the outermost and middle elements are 21° and 8°, respectively, and for the inner element, 14° in the opposite rotation.

* * * * *

UNITED STATES PATENT AND TRADEMARK OFFICE

CERTIFICATE OF CORRECTION

PATENT NO. : 7,585,088 B2
APPLICATION NO. : 11/695718
DATED : September 8, 2009
INVENTOR(S) : Glenn M. Tyson It is certified that error appears in the above-identified patent and that said Letters Patent is hereby corrected as shown below:

In the Claims

At Column 5, line 45:

Please delete “are” and replace with “is”.

At Column 6, line 19:

Please delete “set” and replace with “sets”.

At Column 6, line 31:

Please delete “one”.

At Column 6, line 32:

Please delete “set” and replace with “sets”.

At Column 6, line 57:

Please delete “set” and replace with “sets”.

At Column 7, line 1:

Please delete “one” and replace with “two”.
Please delete “set” and replace with “sets”.

Signed and Sealed this
Twenty-ninth Day of April, 2014

Michelle K. Lee

Michelle K. Lee
*Deputy Director of the United States Patent and Trademark Office*